US006006676A

United States Patent [19]

Creek et al.

[11] Patent Number: 6,006,676

[45] Date of Patent: Dec. 28, 1999

[54] MODULAR PACKAGING SKID

[75] Inventors: Thomas Joseph Creek, Gahanna; Robert Henry Broehl, Worthington, both of Ohio

[73] Assignee: Worthington Industries, Inc., Columbus, Ohio

[21] Appl. No.: 09/121,884

[22] Filed: Jul. 24, 1998

Related U.S. Application Data

[60] Provisional application No. 60/053,741, Jul. 25, 1997.

[51] Int. Cl.[6] ..... B65D 19/44

[52] U.S. Cl. ..... 108/55.3

[58] Field of Search ..... 108/55.1, 55.3, 108/55.5, 53.1, 51.11; 410/3, 4, 30, 67

[56] References Cited

U.S. PATENT DOCUMENTS

| | | | |
|---|---|---|---|
| 354,010 | 12/1886 | Black . | |
| 3,010,409 | 11/1961 | De Good et al. . | |
| 3,912,139 | 10/1975 | Bowman . | |
| 4,307,985 | 12/1981 | Desprez et al. | 108/55.1 X |
| 4,347,794 | 9/1982 | Nordstrom | 108/55.1 X |
| 5,398,832 | 3/1995 | Clive-Smith | 108/55.3 X |
| 5,497,708 | 3/1996 | Jeruzal | 108/55.3 X |
| 5,505,140 | 4/1996 | Wittmann | 108/55.1 X |
| 5,676,066 | 10/1997 | Cavalier et al. | 108/55.1 |
| 5,706,738 | 1/1998 | Rapeli | 108/55.1 X |

*Primary Examiner*—Jose V. Chen

*Attorney, Agent, or Firm*—Fay, Sharpe, Fagan, Minnich & McKee, LLP

[57] ABSTRACT

A packaging skid or pallet having a base including a bottom surface, two side surfaces and two end surfaces. A pair of longitudinally extending channel members are secured to the base and define cavities for receiving lifting forks associated with a lift truck. A number of transversely extending cross members are secured to the channel members and/or the base. A first support tray is fixed to the base between the channel members and two cross member for receiving and retaining a front wheel associated with a motorcycle. A second support tray is fixed to the base between the channel members and two different cross members. A chock is positioned within the second support tray to support a back wheel of the motorcycle. The chock can be repositioned within the second support tray to accommodate motorcycles having different wheelbases. The components of the skid are formed from light weight rolled steel to resist corrosion and to reduce weight compared to a comparable wooden skid.

22 Claims, 5 Drawing Sheets

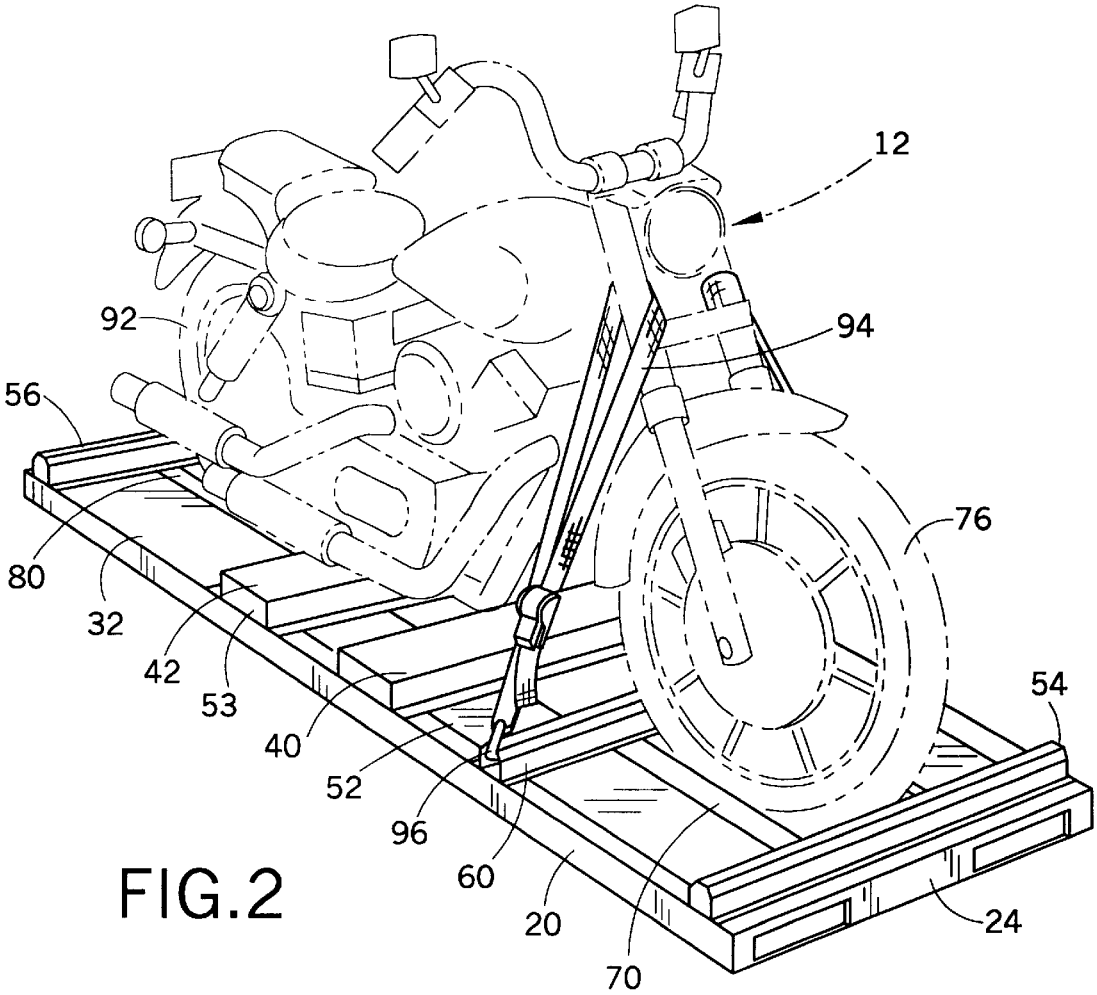
FIG.2
FIG.5
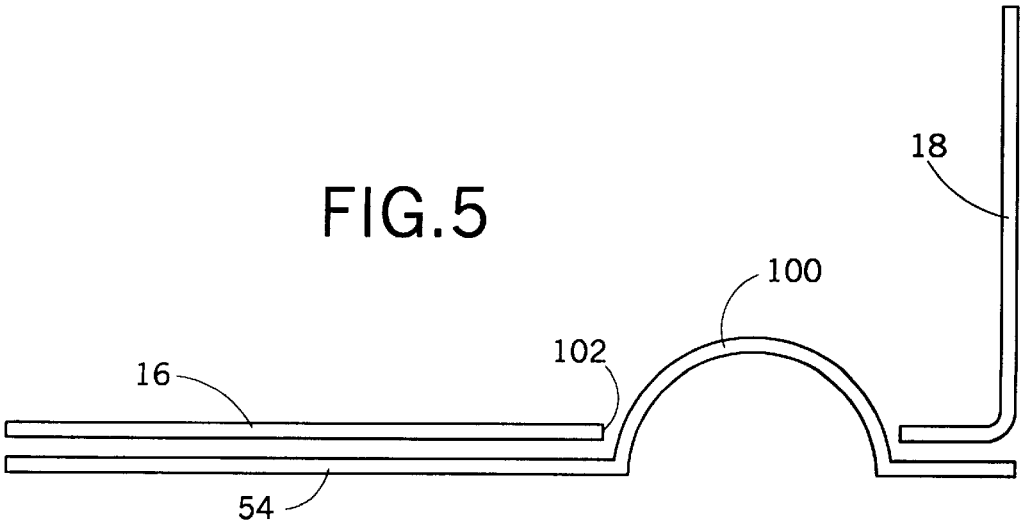

MODULAR PACKAGING SKID

CROSS REFERENCE TO RELATED APPLICATIONS

This application claims the benefit of U.S. provisional patent application No. 60/053,741, filed Jul. 25, 1997 and incorporated herein by reference.

BACKGROUND OF THE INVENTION

The present invention relates to the packaging arts. It finds particular application in conjunction with a skid for shipping wheeled items such as motorcycles, and will be described with particular reference thereto. However, it should be appreciated that the present invention may also find application in conjunction with other types of packaging and shipping systems and applications which require objects to be shipped or transported on skids or pallets.

Past practice in the packaging industry has been to use pallets or skids formed from a composite of wood and cardboard. In recent years, the use of wood has become less attractive due to disposal issues, the supply and quality of wood available for use as a pallet or skid, and the cost of raw wood materials. In addition, wood pallets or skids are flammable, susceptible to insects and biological agents, and promote the corrosion of metal parts.

Accordingly, it has been considered desirable to develop a new and improved packaging skid which meets the above-stated needs and overcomes the foregoing difficulties and others while providing better and more advantageous results.

SUMMARY OF THE INVENTION

In accordance with one aspect of the present invention, a skid is disclosed. The skid includes a base, a first channel member secured to the base, and a second channel member secured to the base and spaced from the first channel member. A plurality of transverse cross members are each secured to at least one of the channel members and the base. A first support member is positioned between the first and second channel members and between a first cross member and a second cross member of the plurality of cross members for supporting a first portion of an object thereon. The first support member cooperates with the first and second cross members to substantially prevent the first portion of the object from moving relative to the base. A second support member is positioned between the first and second channel members and between a third cross member and a fourth cross member of the plurality of cross members for receiving a chock for supporting a second portion of the object thereon. The chock is sized to shift longitudinally along the second support member to accommodate objects of varying length.

In accordance with another aspect of the present invention, a skid is disclosed. The skid includes a base, a first channel member secured to the base, and a second channel member secured to the base and spaced from the first channel member. A plurality of transverse cross members are each secured to at least one of the channel members and the base. A support member is positioned between the first and second channel members. The support member includes a first section defined between a first cross member and a second cross member of the plurality of cross members for receiving a first chock for supporting a portion of an object thereon. The first chock and the first section are sized to substantially prevent the first chock from moving within the first section. The support member further includes a second section defined between a third cross member and a fourth cross member of the plurality of cross members for receiving a second chock for supporting another portion of the object thereon. The second chock and the second section are sized to permit the second chock to shift longitudinally within the second section to accommodate objects of varying length.

In accordance with yet another aspect of the present invention, a skid is disclosed. The skid includes a base for supporting an object secured thereto, a first support substantially fixed to the base for supporting a first portion of the object, and a second support for supporting a second portion of the object. The second support is movable relative to the base to accommodate objects of varying length.

In accordance with a further aspect of the present invention, a method of supporting an object on a skid is disclosed. The skid includes a base, a first support substantially fixed to the base for supporting a first portion of the object, and a second support for supporting a second portion of the object, the second support being movable relative to the base to accommodate objects of varying length. The method includes the steps of placing the first portion of the object on the first support, adjusting the position of the second support relative to the base so that the second portion of the object can be placed on the second support, and holding the object on the skid.

One advantage of the present invention is the provision of a skid or pallet which can be reconfigured to accommodate objects of varying length.

Another advantage of the present invention is the provision of a skid or pallet that is formed from a material that is immune from insects and biological agents.

Yet another advantage of the present invention is the provision of a skid or pallet that is formed from a readily recyclable material.

Still another advantage of the present invention is the provision of a skid or pallet that is formed from a light weight material relative to an equivalent wooden pallet.

A further advantage of the present invention is the provision of a skid or pallet that can be arranged in a stacked configuration to facilitate return to a manufacturing or assembly facility for reuse.

Still further advantages of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

FIG. 2 is a perspective view from the front of a motorcycle secured to the packaging skid of FIG. 1;

FIG. 5 is an enlarged side elevation view, partially broken away, of two skids in a stacked configuration along the line 5—5 in FIG. 1;

DETAILED DESCRIPTION OF THE PREFERRED EMBODIMENTS

Figure 1:
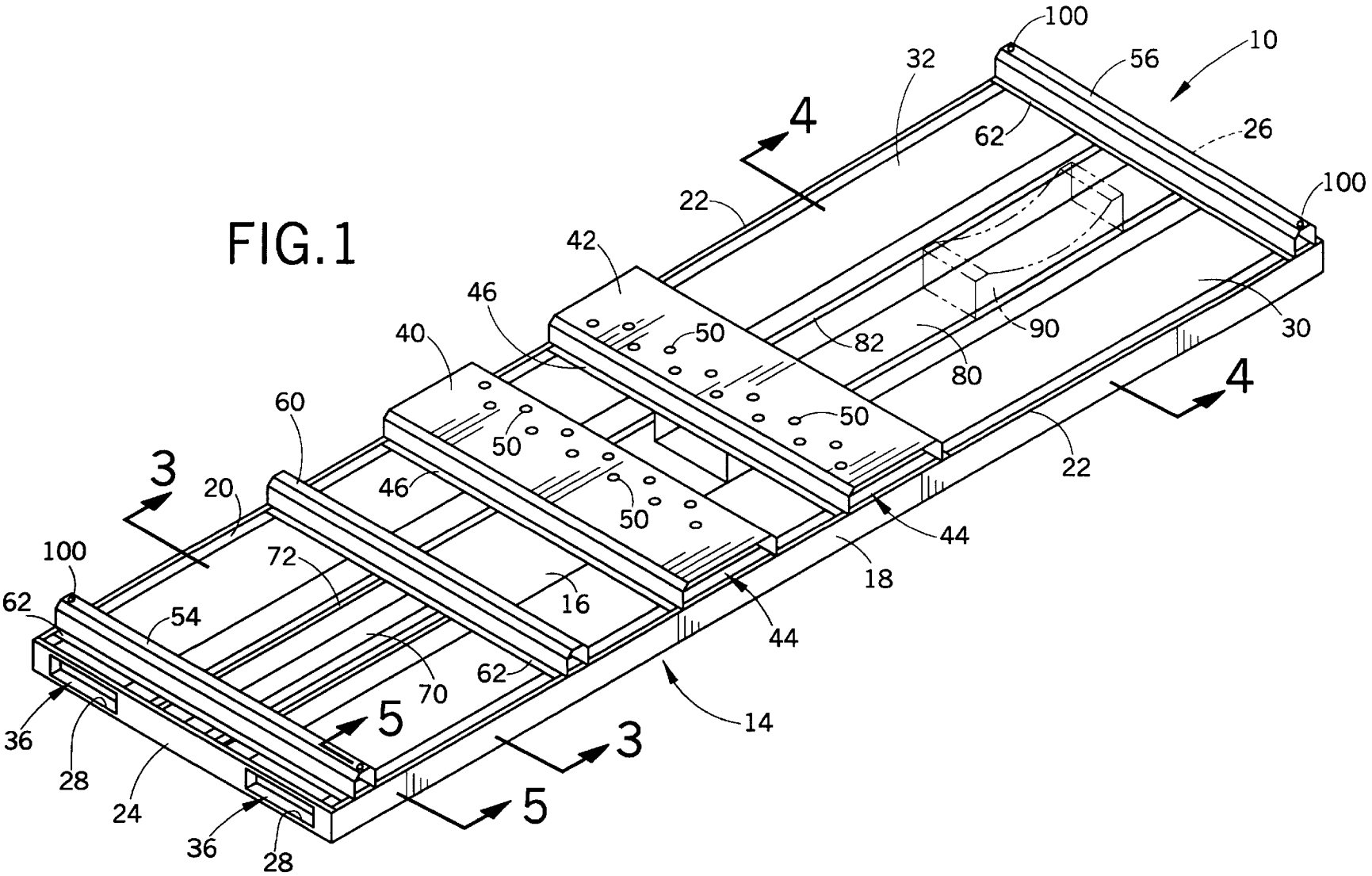
FIG. 1 is a perspective view of a packaging skid which incorporates the features of the present invention therein.

FIG. 1 illustrates a reusable pallet or packaging skid 10 which incorporates the features of the present invention therein. The skid 10 finds particular application in conjunction with transporting a wheeled vehicle such as a motorcycle 12 (FIG. 2).

Figure 3:
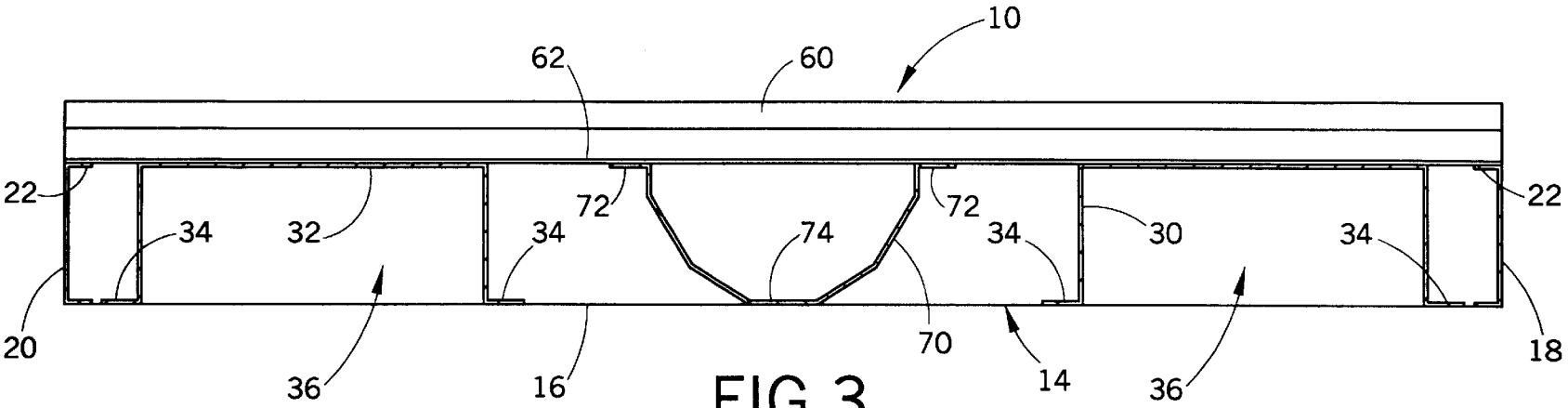
FIG. 3 is a cross sectional view of the skid of FIG. 1 along line 3—3.
Figure 4:
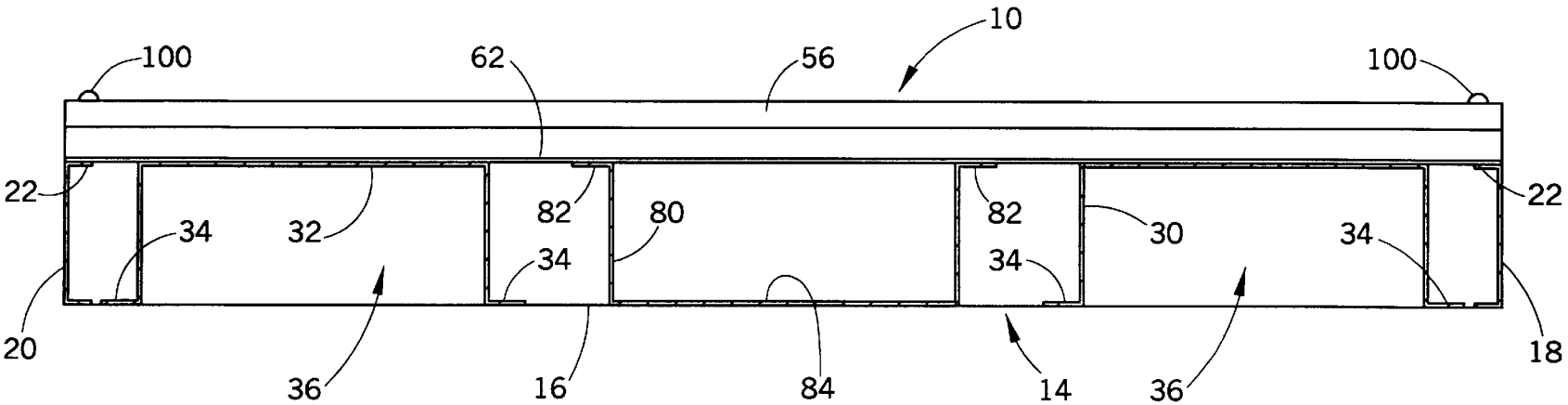
FIG. 4 is a cross sectional view of the skid of FIG. 1 along line 4—4.

With continuing reference to FIGS. 1 and 2, and particular reference to FIGS. 3 and 4, the skid 10 includes a rectangular tray 14 including a bottom surface 16 and side surfaces 18, 20. Each side surface includes an upper flange 22, preferably extending inward over the bottom surface 16. The tray 14 further includes end surface 24 joined to the bottom and sides. Although not visible in the drawings, an end surface 26, substantially identical to end surface 24, is joined to the bottom and sides. At least the end surface 24 includes spaced rectangular apertures 28 therethrough.

First and second "U-shaped" channel members 30, 32 extend longitudinally in the tray between the end surfaces 24, 26. The channel members open downward toward the bottom surface and include lower flanges 34 which are secured or otherwise attached to the bottom surface 16. The channel members are substantially rectangular in cross section and cooperate with the respective end surface apertures 28 and the bottom surface 16 to define closed cavities 36 for receiving lifting forks associated with a conventional lift truck.

First and second spaced cross members 40, 42 extend transversely across the side surfaces and channel members substantially midway between the end surfaces 24, 26. The cross members 40, 42 are "U-shaped" and open downward toward the channel members. In particular, the cross members 40, 42 are rectangular in cross section and define cavities 44 for receiving lifting forks in directions transverse to the channel members 30, 32. The cross members include lower flanges 46 on each side thereof (one side shown) which are secured or otherwise attached to at least the side surface flanges 22. The flanges 46 can also be secured or attached to the upper surfaces of the channel members 30, 32.

A plurality of apertures or depressions 50 extend through or deform an upper surface of at least one of the cross members 40, 42. The apertures or depressions are adapted to receive mutually conforming protrusions (not shown) from at least one bracing member 52 (FIG. 2). The bracing member supports a lower portion of the motorcycle when it is secured to the skid.

The bracing member protrusions can be snap fit or friction fit into the apertures 50. Alternatively, the bracing member can have apertures 53 therein to accommodate conventional fasteners (not shown) by which the bracing member is secured to at least one of the cross members 40, 42. To this end, the cross bar apertures 50 can be aligned with the bracing member apertures 53 to allow a stem of a fastener to pass therethrough. The bracing member 52 can be formed from a suitable, light-weight reusable material such as plastic, cardboard, wood, etc.

A third cross member 54, and a fourth cross member 56 extend transversely across the side surfaces 18, 20 and channel members 30, 32 at respective ends thereof. Likewise, a fifth cross member 60 extends transversely across the side surfaces 18, 20 and channel members 30, 32 between the first and third cross members 40, 54. The cross members 54, 56, 60 are "U-shaped" and open downward toward the channel members. The cross members include lower flanges 62 on each side thereof (one side shown) which are secured or otherwise attached to at least the side surface flanges 22. The flanges 62 can also be secured or attached to the upper surfaces of the channel members 30, 32.

A first support tray 70 is positioned centrally between the channel members 30, 32 and longitudinally between the third and fifth cross members 54, 60. The support tray 70 is substantially "U-shaped" and opens upward toward the cross members 54, 60. The support tray includes upper flanges 72 on each side thereof which are secured or otherwise attached to the flanges 62 associated with the first and third cross members 54, 60. A bottom surface 74 of the support tray rests on and can be positively secured or attached to the tray bottom surface 16.

The support tray 70 is substantially arcuate in cross section and is adapted to receive a mutually conforming front tire 76 associated with the motorcycle 12. When the front tire is positioned within the support tray, the cross members 54, 60 cooperate to restrain or confine the wheel to within the tray. Thus, the size of the tray and the spacing of the cross members is selected to prevent or at least minimize longitudinal movement of the tire, relative to the skid.

A second support tray 80 is positioned centrally between the channel members 30, 32 and longitudinally between the second and fourth cross members 42, 56. The tray 80 is substantially "U-shaped" and opens upward toward the cross members 42, 56. The support tray 80 is substantially rectangular in cross section and includes upper flanges 82 on each side thereof which are secured or otherwise attached to the cross member flanges 46, 62. A bottom surface 84 of the support tray rests on and can be positively secured or attached to the tray bottom surface 16.

As shown in FIG. 1, a wheel chock 90 (phantom) is positioned within the second tray 80. The wheel chock 90 has a length less than the distance separating the cross members 42, 56 to permit the chock 90 to be repositioned longitudinally within the second tray. As a result, objects (i.e., motorcycles) of different sizes (i.e., having different wheel bases) can be equally supported and secured to the skid 10 by simply repositioning the wheel chock 90 within the second tray 80, based on the size of the object being supported.

For instance, the wheel chock 90 can be positioned within the tray 80 to receive a second wheel 92 of the motorcycle 12. The wheel chock 90 includes an arcuate upper surface adapted to receive and restrain the tire 92. Thus, the motorcycle wheel 92 prevents or at least minimizes movement of the chock 90 relative to the skid 10. That is, with the wheel 76 resting in the first support tray 70, the wheel chock 90 is prevented from moving within the second support tray 80 relative to the skid 10. The chock 90 can be friction fit within the support tray 90.

After the front tire is positioned within the support tray 70 and the rear tire is positioned on the wheel chock 90, the motorcycle can be further secured to the skid 10 by conventional tie-down straps 94 which can be attached between the motorcycle, such as the front fork, and any one of the frame members or cross members. In the embodiment being described, the tie-down straps are attached to securing means 96 such as an eye bolt, a hook, or the like, associated with the cross member 60. The trays 70 and 80 can be of different widths to accommodate tires of different widths.

It should be appreciated that the skid 10 may serve as a metal base for supporting protective side surfaces and a top panel. The use of light gauge steel around the outside of the skid 10 permits removable cardboard or wooden side panels to be fastened to the skid 10 with staples, nails, or the like to provide further protection to the motorcycle during shipping and storage.

The skid or pallet 10 is suitable for use in transporting wheeled vehicles, such as from a manufacturing or assembly facility to a retail or distribution site. In particular, a motorcycle can be mounted to the skid or frame as previously described for shipment. Upon arrival the skid or pallet 10 may be reused by returning the skid or pallet to the manufacturing or assembly facility. The skid 10 incorporate means for stacking plural skids in an interlocking arrangement to facilitate efficiently and compactly returning the skids to the manufacturing or assembly facility for reuse.

In particular, with reference to FIG. 5, the skid 10 includes a number of protrusions 100 extending upward from the top surfaces of the cross members, such as cross members 54, 56. The bottom tray surface 16 includes a number of apertures or recesses 102 that are positioned to receive protrusions associated with a second skid positioned below a first skid in a stacked arrangement. Thus, a plurality of empty skids can be arranged in an interlocking stacked configuration to facilitate returning the skids for reuse.

One or more of the tray 14, channel members 30, 32, cross members 40, 42, 54, 56, 60 and support trays 70, 80 are roll-formed from light gauge steel. Each of the steel sections can be coated or plated with zinc, oils, or the like, in order to resist corrosion. Thus, the light gauge steel sections are immune to attack by insects and other biological agents. In addition, the light gauge steel components are recyclable and are typically lighter in weight relative to an equivalent wood skid.

It should be appreciated that one or more of the tray, channel members, cross members, and/or trays can be formed from other materials such as wood-based, paper-based, metal-based, plastic-based, composite-based, etc. materials. Further, the channel members 30, 32, cross members 40, 42, 54, 56, 60 and support trays 70, 80 can be joined or attached to the tray 14 and/or each other by welding or brazing, or with conventional securing means such as screws, bolts, or the like.

Figure 6:
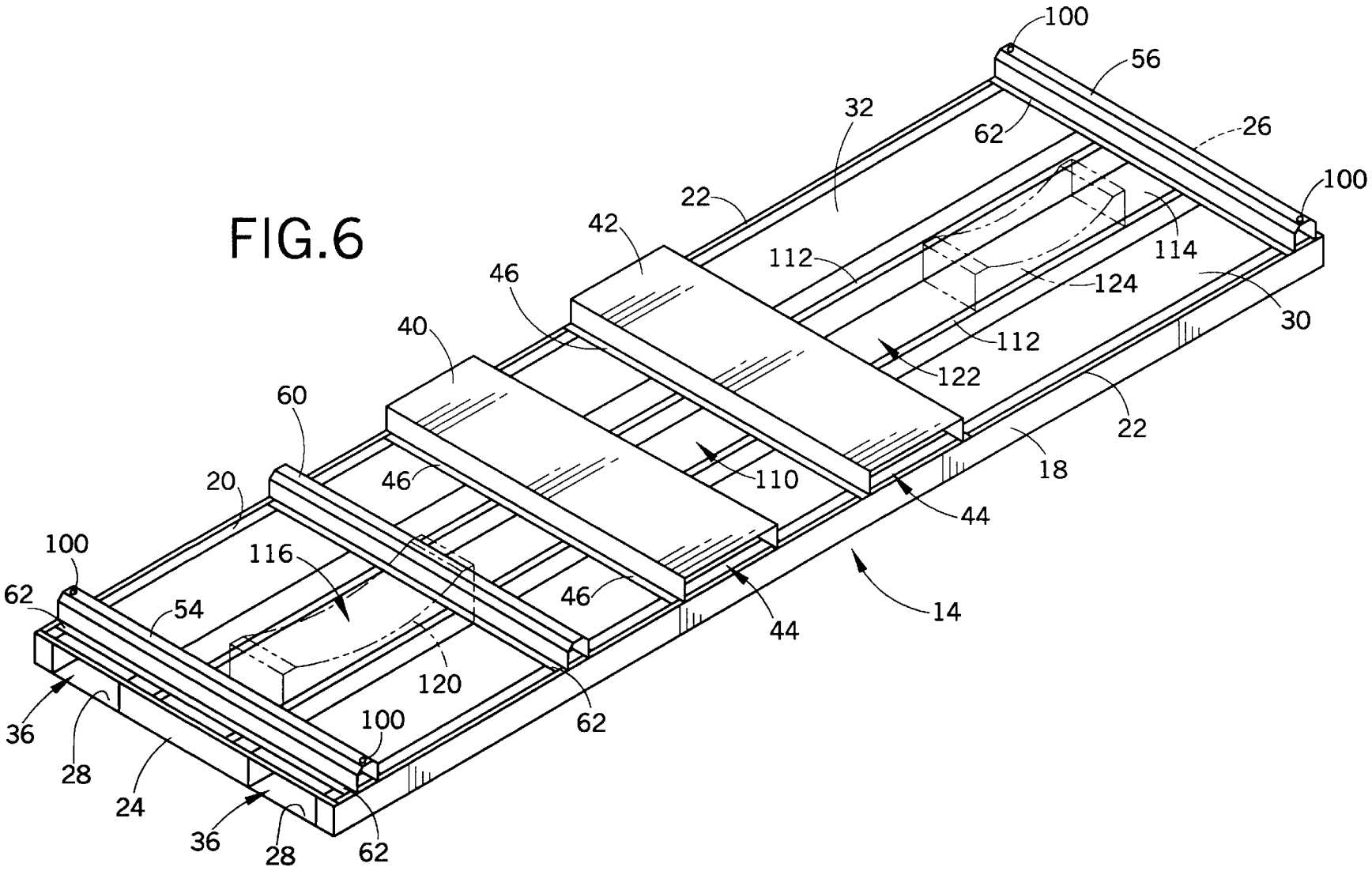
FIG. 6 is a perspective view of another packaging skid which incorporates the features of the present invention therein.

Referring now to FIG. 6, the skid 10 can be modified by replacing the first and second support trays 70, 80 with a single "U-shaped" support tray 110. The support tray 110 is positioned centrally between the channel members 30, 32 and longitudinally between the end surfaces 24, 26. The support tray 110 opens upward toward the cross members 40, 42, 54, 56, 60 and is substantially rectangular in cross section. The support tray includes upper flanges 112 on each side thereof which are secured or otherwise attached to the cross member flanges 46, 62. A bottom surface 114 of the support tray 110 rests on and can be positively secured or attached to the tray bottom surface 16.

Figure 7:
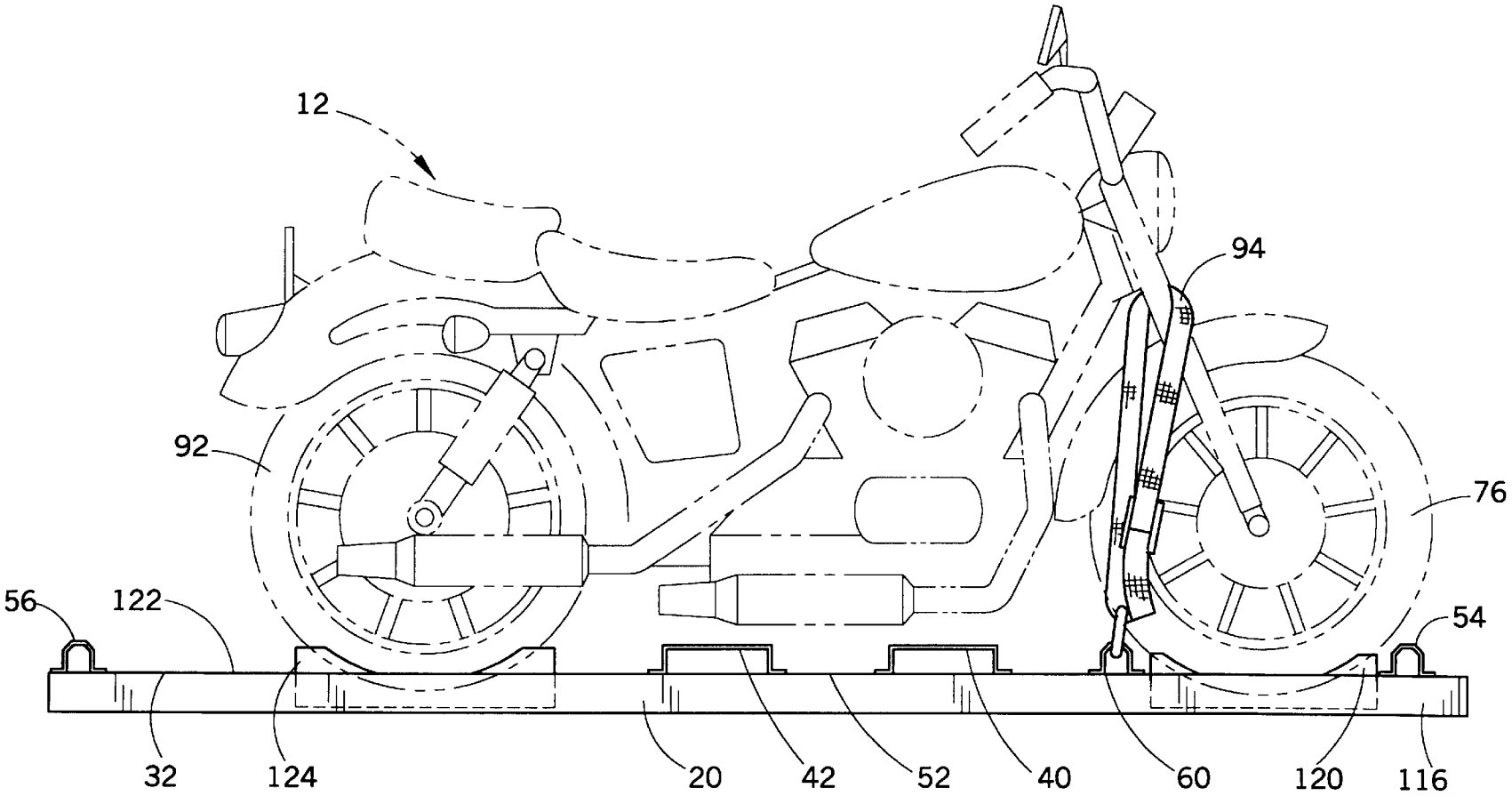
FIG. 7 is a side elevation view of a motorcycle secured to the packaging skid of FIG. 6.

A first section 116 of the support tray 110 is defined between the cross members 54, 60. With reference to FIG. 7, a first wheel chock 120 is positioned within the first section 116. The cross members 54, 60 cooperate to restrain or confine the wheel chock 120 within the first section 116. Preferably, the wheel chock 120 is sized to prevent or at least minimize longitudinal movement within the first section. That is, the wheel chock 120 has a length substantially equal to the distance separating the cross members 54, 60 resulting in minimal longitudinal movement of the wheel chock 120, if any, relative to the skid 10.

The wheel chock 120 includes an arcuate upper surface adapted to receive and restrain the tire 76 of the motorcycle 12. Thus, the wheel chock 120 prevents or at least minimizes movement of the motorcycle 12 relative to the skid 10.

A second section 122 of the support tray 110 is defined between the cross members 42, 56. A second wheel chock 124 is positionable within the second section 122. The cross members 42, 56 cooperate to restrain or confine the wheel chock 124 to longitudinal movement within the second section 122.

The wheel chock 124 has a length less than the distance separating the cross members 42, 56 to permit longitudinal movement of the chock 124 within the second section. As a result, objects (i.e., motorcycles) of different sizes (i.e., having different wheel bases) may be equally supported and secured to the skid 10 by repositioning the second wheel chock 124 within the second support tray section 122, based on the size of the object being supported.

For instance, the second wheel chock 124 can be positioned within the second section 122 to receive the second wheel 92 of the motorcycle 12. With the wheel 92 resting on an upper arcuate surface the second wheel chock 124, the wheel chock is prevented from moving within the tray section 122 relative to the skid 10. The cross members 42, 56 do not prevent longitudinal movement of the wheel chock 124 within the tray section 122. However, if desired, the chocks 120, 124 may be friction fit within the respective tray sections 112, 122.

It should be appreciated that by using two separate trays 70, 80 (FIG. 1) having a combined length less than the single support tray 110, a skid incorporating the separate trays 70, 80 weighs less than a skid incorporating the single tray 110. Further, a skid incorporating the separate trays 70, 80 is more flexible than a skid incorporating the single tray 110.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A skid comprising:

a base;

a first channel member secured to the base;

a second channel member secured to the base and spaced from the first channel member;

a plurality of transverse cross members each secured to at least one of the channel members and the base;

a first cross member and a second cross member of the plurality of cross members cooperating with the first and second channel members to define a first recess, the first and second cross members being spaced apart a predetermined distance to facilitate retaining a first portion of an associated object within the recess; and a third cross member and a fourth cross member of the plurality of cross members cooperating with the first and second channel members to define a second recess spaced from the first recess and adapted to receive a chock for supporting a second portion of the associated object, the chock being sized to shift longitudinally within the second recess to accommodate associated objects of varying length.

2. The skid of claim 1, wherein the first and second channel members define cavities for receiving lifting forks associated with a fork lift vehicle.

3. The skid of claim 1, wherein two cross members of the plurality of cross members define cavities for receiving lifting forks associated with a fork lift vehicle.

4. The skid of claim 1, wherein the base defines a tray including a bottom surface, two side surfaces, and two end surfaces, the end surfaces having apertures therethrough for communicating with cavities defined by the channel members.

5. The skid of claim 1, wherein the base, channel members, cross members, and support members are formed from rolled steel.

6. The skid of claim 1, wherein the associated object is a motorcycle, and the first and second portions are tires of the motorcycle.

7. The skid of claim 1, further including:

a first support member positioned within the first recess and having an arcuate cross section adapted for supporting a first portion of an object; and a second support member positioned within the second recess and having a rectangular cross section adapted for supporting the chock.

8. The skid of claim 1, further including at least one tie-down strap for securing the associated object to at least one of the plurality of cross members.

9. The skid of claim 1, further including a first interlocking member positioned on at least one of the plurality of cross members, and a second interlocking member positioned on the base, wherein a first interlocking member of a lower skid engages with a second interlocking member of an upper skid in a stacked arrangement.

10. The skid of claim 1, further including a removable bracing member secured to at least one of the plurality of cross members for supporting a third portion of the associated object.

11. A skid comprising:

a base;

a first channel member secured to the base;

a second channel member secured to the base and spaced from the first channel member;

a plurality of transverse cross members each secured to at least one of the channel members and the base;

a support member positioned between the first and second channel members, the support member including a first recess defined between a first cross member and a second cross member of the plurality of cross members, the first recess being adapted to receive a first chock for supporting a portion of an associated object thereon and being adapted to prevent the portion of the associated object from freely moving relative to the base; and the support member further including a second recess defined between a third cross member and a fourth cross member of the plurality of cross members, the second recess being adapted to receive a second chock for supporting another portion of the associated object thereon, the second chock being adapted to shift longitudinally within the second recess to accommodate associated objects of varying length.

12. The skid of claim 11, wherein the first and second channel members define cavities for receiving lifting forks associated with a fork lift vehicle.

13. The skid of claim 11, wherein two cross members of the plurality of cross members define cavities for receiving lifting forks associated with a fork lift vehicle.

14. The skid of claim 11, wherein the base defines a tray including a bottom surface, two side surfaces, and two end surfaces, the end surfaces having apertures therethrough for communicating with cavities defined by the channel members.

15. The skid of claim 11, wherein the base, channel members, cross members, and support member are formed from rolled steel.

16. The skid of claim 11, wherein the associated object supported is a motorcycle, and the first and second portions are tires of the motorcycle.

17. The skid of claim 11, further including at least one tie-down strap for securing the associated object to at least one of the plurality of cross members.

18. A shipping or storage skid for supporting an associated vehicle having a plurality of wheels, the skid comprising:

a base;

a first chock positioned on the base, the first chock including a front chock portion adapted to support a front wheel portion of an associated first wheel and a back chock portion adapted to support a back wheel portion of the associated first wheel; and a second chock positioned on the base, the second chock including a front chock portion adapted to support a front wheel portion of an associated second wheel and a back chock portion adapted to support a back wheel portion of the associated second wheel, the second chock being movable relative to the base to accommodate vehicles having varying distances between the first and second wheels thereof.

19. The skid of claim 18, wherein the first and second chocks are removable from the base.

20. A method of supporting an associated vehicle on a skid including a base, a first chock positioned on the base, the first chock including a front chock portion adapted to support a front wheel portion of an associated first wheel and a back chock portion adapted to support a back wheel portion of the associated first wheel, and a second chock positioned on the base, the second chock including a front chock portion adapted to support a front wheel portion of an associated second wheel and a back chock portion adapted to support a back wheel portion of the associated second wheel, the second chock being movable relative to the base to accommodate vehicles having varying distances between the first and second wheels thereof, the method comprising the steps of:

placing the first wheel of the vehicle on the first chock;

adjusting a position of the second chock relative to the base to locate the second wheel of the vehicle on the second chock; and securing the vehicle to the skid.

21. The method of claim 20, further including the step of:

securing a removable bracing member to the base for supporting a third portion of the vehicle.

22. The method of claim 20, wherein the adjusting step includes the step of adjusting the position of the second chock within a support tray secured to the base.

* * * * *